United States Patent [19]

Andres et al.

[11] Patent Number: 4,776,940

[45] Date of Patent: Oct. 11, 1988

[54] GASKET ASSEMBLY FOR MEMBRANE ELECTROLYSIS CELLS

[75] Inventors: Peter Andres, Offenbach am Main; Manfred Bodenburg, Frankfurt am Main; Wolfgang Türke, Schöneck, all of Fed. Rep. of Germany

[73] Assignee: Metallgesellschaft Aktiengesellschaft, Frankfurt am Main, Fed. Rep. of Germany

[21] Appl. No.: 156,370

[22] Filed: Feb. 16, 1988

[30] Foreign Application Priority Data

Feb. 25, 1987 [DE] Fed. Rep. of Germany ..... 3705926

[51] Int. Cl.[4] ..... C25B 9/00; C25B 13/06; C25B 13/08

[52] U.S. Cl. ..... 204/253; 204/279

[58] Field of Search ..... 204/279, 282, 253–254, 204/255–258, 252, 263–266

[56] References Cited

U.S. PATENT DOCUMENTS

| | | | |
|---|---|---|---|
| 4,013,535 | 3/1977 | White | 204/252 |
| 4,332,661 | 6/1982 | Ford et al. | 204/253 |
| 4,431,502 | 2/1984 | Ford | 204/279 X |
| 4,472,255 | 9/1984 | Millington et al. | 204/255 |
| 4,610,765 | 9/1986 | Beaver et al. | 204/279 X |
| 4,721,555 | 1/1988 | Grosshandler | 204/253 X |

*Primary Examiner*—Donald R. Valentine
*Attorney, Agent, or Firm*—Herbert Dubno

[57] ABSTRACT

The gasket is disposed between the electrode frames, which are pressed against each other and are used in a membrane electrolysis for producing sodium solution, hydrogen and chlorine from an NaCl brine. The rim of the membrane is disposed between two parts of the gasket. At least one gasket part consists of a core frame, which is provided at least on one side with an attached sealing frame made of graphite. The core frame and the sealing frame are enclosed in a plastic film wrapper. The core frame may be made of asbestos and the plastic film wrapper may be made of polytetrafluoroethylene.

11 Claims, 1 Drawing Sheet

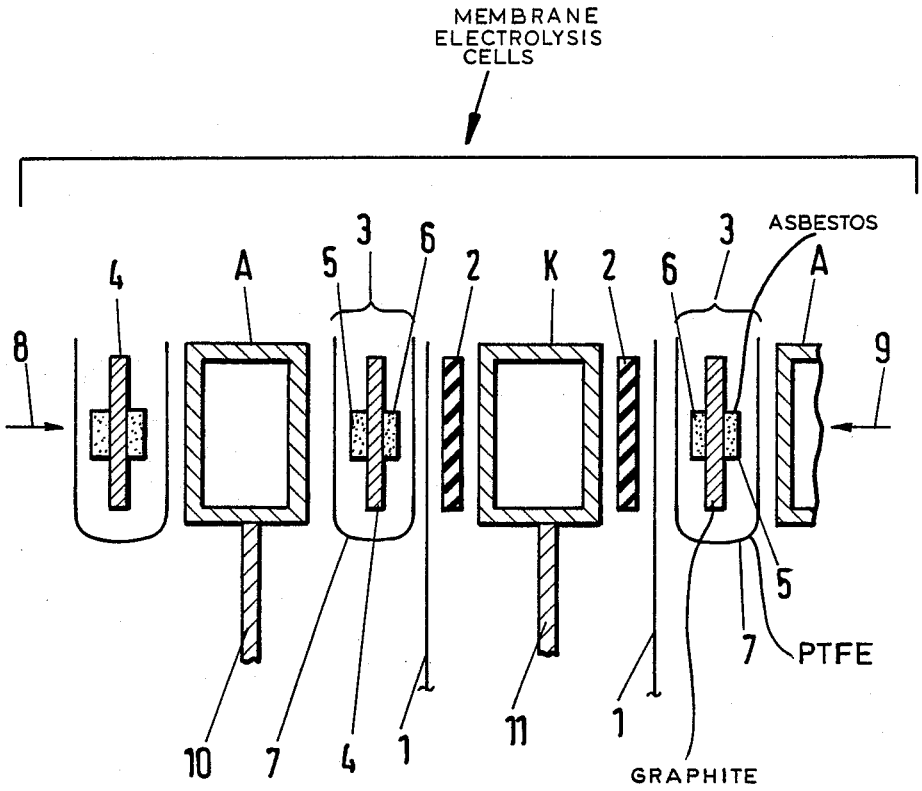
MEMBRANE
ELECTROLYSIS
CELLS
ASBESTOS
PTFE
GRAPHITE
A
K
A
1
2
3
4
5
6
7
8
9
10
11

GASKET ASSEMBLY FOR MEMBRANE ELECTROLYSIS CELLS

FIELD OF THE INVENTION

Our present invention relates to a gasket for the electrode frames which are pressed against one another and are used for membrane electrolysis which produces sodium hydroxide solution, hydrogen and chlorine from an NaCl brine, and wherein the membrane has a rim disposed between the two parts of the gasket

BACKGROUND OF THE INVENTION

The membrane used for the membrane electrolysis of NaCl brine to produce NaOH, $H_2$ and $Cl_2$ usually has ion exchange properties so that water can permeate the membrane which permits migration of sodium through the membrane.

Owing to the ability of the membrane to transport water, problems may arise in connection with the sealing of the membrane electrolyzer. Particularly, care must be taken to prevent water from extruding outwardly through the edge of the membrane. In order to prevent this, the membrane must be compressed adjacent to the gasket. If rubber gaskets are used on both sides of the membrane, the pressure applied will cause said gaskets to expand parallel to the surface of the membrane and that movement will result in damage to or destruction of the membrane.

OBJECTS OF THE INVENTION

It is an object of our invention to provide a gasket which can transmit sufficiently strong forces acting on the membrane at right angles thereto without a deformation of the gasket resulting in a transmission of strong forces which are parallel to the membrane.

It is another object of our invention to provide an improved gasket assembly which is resistant to the liquid that is contained in the electrolyzers and which consists of an unsaturated sodium chloride solution which has a pH value of about 4.5 and in addition to chlorate and hypochlorous acid which contains dissolved and gaseous chlorine.

SUMMARY OF THE INVENTION

These objects are attained in accordance with the invention in that at least one part of the gasket consists of a core frame that is provided at least on one side with a sealing frame attached thereto and the core frame and the sealing frame being surrounded or enclosed in a plastic film wrapper.

In the gasket in accordance with the invention the core frame consists, e.g., of asbestos and is provided particularly to facilitate the handling of that part of the gasket because the gasket frame made of graphite is usually thin and narrow. The plastic film wrapper ensures that the gasket part will resist corrosion and may be made, e.g., of polytetrafluoroethylene (PTFE).

Sealing pressures in the range from 700 to 2000 $N/cm^2$ and preferably in the range from 900 to 1500 $N/cm^2$ are applied.

Under such pressures, which are not excessive, it will usually be sufficient for the two-part gasket disposed on both sides of the membrane to comprise only one part that is designed in accordance with the invention whereas a rubber gasket may be used as the other part of the gasket.

The gasket frame made of graphite may be rather narrow so that the sealing region of the rubber gasket is narrow too and will not appreciably be deformed in a direction which is parallel to the surface of the membrane.

BRIEF DESCRIPTION OF THE DRAWING

The above objects, features and advantages of our invention will become more readily apparent from the following description, reference being made to the accompanying drawing, the sole FIGURE of which is a vertical sectional view showing the sealing portion of a membrane electrolyzer with the parts in spaced apart relation or exploded form.

SPECIFIC DESCRIPTION

The frame of the anode A and that of the cathode K consist each of a square-section tube but may alternatively consist of a circular section tube, for instance.

A rubber gasket 2 is disposed between the membrane 1 and the cathode frame. That part 3 of the gasket which is disposed between the membrane 1 and the anode tube consists of a flat core frame 4 made of asbestos, the two sealing frames 5, 6 which are made of graphite and are attached to the core frame, and the plastic film wrapper 7 made of PTFE.

The sealing frame 5 facing the anode A may be omitted in some cases. The wrapper 7 ensures that chlorine formed on the anode plate 10 will not destroy the gasket part 3.

The hydrogen which is formed on the cathode plate 11 and the sodium hydroxide solution formed there are much less aggressive so that the rubber gasket 2 is sufficient in that region although the rubber gasket 2 may be replaced by a gasket which is similar to the gasket part 3.

The parts are shown in spaced apart relation in the drawing and in operation are forced against each other in the directions indicated by the arrows 8 and 9 which also represent means for compressing the horizontal electrode stack.

The sealing frames 5, 6 made of graphite will ensure that adjacent to the gasket the membrane 1 will not be subjected to appreciable forces which are at right angles to the pressure applied and which could result in damage to the membrane.

Between the rubber gasket 2 on one side and the gasket part 3 on the other side the membrane 1 is so squeezed adjacent to the gasket that no liquid can leak out through the membrane. The sealing frame 5, 6 of graphite can be made of a graphite which has a certain elasticity only in the directions of the arrows 8 and 9 but has no elasticity at right angles to this direction.

The core frame 4 made of asbestos may have a thickness of about 2 mm. The thickness of the sealing frames 5, 6 made of graphite is, in most cases, in the range from 0.5 to 2 mm and the PTFE wrapper 7 preferably has a thickness of 0.3 mm.

We claim:

1. A gasket assembly for sealing cells formed by electrode frames in membrane electrolysis, said assembly comprising:

a plurality of electrolysis electrodes each provided with a peripheral electrode frame and forming a stack;

a respective membrane between each pair of electrodes and having a rim received between the frames of the respective pair of electrodes; and a respective sealing gasket received between each of said rims and a respective one of the frames of the respective pair of electrodes, at least one of the gaskets between each of said rims and a frame of a respective pair of electrodes comprising:

a core frame, at least one sealing frame composed of graphite on a side of the core frame juxtaposed with the rim of the respective membrane, and a plastic film wrapper around said core frame and said sealing frame.

2. The gasket assembly defined in claim 1 wherein each of said core frames is composed of asbestos.

3. The gasket assembly defined in claim 2 wherein said plastic film wrapper is composed of polytetrafluoroethylene.

4. The gasket assembly defined in claim 3 wherein a respective said sealing frame of graphite is provided on a side of each core frame juxtaposed with a respective electrode frame within each said plastic film wrapper.

5. The gasket assembly defined in claim 4 wherein the other of said sealing gaskets of each of said pairs of electrodes is a rubber gasket.

6. The gasket assembly defined in claim 5 wherein the width of the sealing frame juxtaposed with one side of said membrane is narrower than the width of the rubber gasket juxtaposed with the opposite side thereof.

7. The gasket assembly defined in claim 6 wherein each said wrapper has a thickness of about 0.3 mm.

8. The gasket assembly defined in claim 7 wherein each said core frame has a thickness of about 2 mm.

9. The gasket assembly defined in claim 8 wherein said sealing frames each have thicknesses in the range of substantially 0.5 to 2 mm.

10. The gasket defined in claim 9 wherein said frames are pressed together with a pressure in the range of 700 to 2000 $N/cm^2$.

11. The gasket defined in claim 10 wherein said pressure is 900 to 1500 $N/cm^2$.

* * * * *